US005195305A

United States Patent [19]

Dambrosio et al.

[11] Patent Number: 5,195,305

[45] Date of Patent: Mar. 23, 1993

[54] LIQUID PACKAGING PLACEMENT AND CONTROL DEVICE

[75] Inventors: Louis B. Dambrosio, Modesto; Christoper C. Rutter, Oakland; James R. Lackey, Modesto; William F. Charron, Fremont, all of Calif.

[73] Assignee: The Wine Group, Inc., Ripon, Calif.

[21] Appl. No.: 814,364

[22] Filed: Dec. 23, 1991

[51] Int. Cl.[5] ..... B65B 5/04; B65B 35/28

[52] U.S. Cl. ..... 53/473; 53/260

[58] Field of Search ..... 53/473, 260, 255, 173, 53/170, 284.5, 564, 235

[56] References Cited

U.S. PATENT DOCUMENTS 4,124,967 11/1978 Beer et al. ..... 53/473 X
4,215,523 8/1980 Turner ..... 53/260 X
4,464,880 8/1984 Peters et al. ..... 53/260 X
4,760,683 8/1988 Hirschberger et al. ..... 53/255 X
4,864,801 9/1989 Fallas ..... 53/473 X
5,018,338 5/1991 Jurchuk et al. ..... 53/260 X

*Primary Examiner*—James F. Coan
*Attorney, Agent, or Firm*—Owen, Wickersham & Erickson

[57] ABSTRACT

A liquid filled bag loading device stabilizes the bag in a loading position and then releases the bag gently into a open top tray type box which can be easily closed. The loading device provides a powered roller at the entrance to a loading position to assist the bag in entering the loading position. In the loading position the bag floats on an air cushion over a set of trap doors as the bag is stabilized between side and back walls. A gentle tamper device is used to assist in accelerating the bag's stabilization prior to the trap doors opening to drop the bag vertically through a chute into a waiting box.

17 Claims, 8 Drawing Sheets

LIQUID PACKAGING PLACEMENT AND CONTROL DEVICE

BACKGROUND OF THE INVENTION

1. Field of the Invention

This invention relates to the field of packaging of liquid filled flexible containers (namely bags) and their movement and guidance into a rigid protective container (usually a cardboard box).

2. Prior Art

In the beverage industry the use of thin film liquid and gas tight containers, commonly known as bags, is common. The bags often have an oxygen barrier in the thin film to protect the contents of the bag from oxygen in the surroundings. A fill/discharge spout is usually located at one end/corner of the bag. Such an unprotected flexible bag is impractical for storage and handling. It is not stable, cannot be stacked, and is difficult to grasp and hold, also the bag is not durable to any sharp corners or edges or objects which it might encounter. It is, however, less expensive than a rigid container capable of holding a similar volume. Therefore, a common practice which has evolved, is the use of such a flexible liquid filled bag in a cardboard box which protects the bag from shipping and handling hazards such as sharp objects and provides the opportunity to stack and handle the liquid in the bag just like any other commodity shipped in cardboard boxes.

Commonly, a bag is filled with liquid and the liquid filled bag is directed into the box by guiding or conveying it by various means and/or chutes. A patent by Hirschberger, et al., U.S. Pat. No. 4,760,683 provides an example of such loading.

A drawback associated with the prior art devices is that the rough handling received by the bag in guiding it into the cardboard box sometimes results in damage to the bag or placement of the bag spout in an unacceptable location. Faulty placement of the bag can cause its edges to hang out of the box and be damaged by the edges of the box. A slow moving packaging line which reduces the risk of damage is not efficient. Accelerating the process often causes the liquid filled bag to act in a generally predictable but not always consistent manner which causes the box loading process to fail and/or damage the product too often for efficient production.

During an accelerated and naturally variable loading operation, the natural tendency of a liquid filled bag is to start to roll at any point where a barrier or guide is erected to stop or influence the bag's motion. This rolling action often causes the fill/discharge spout of the bag to be displaced a commercially undesirable distance from its intended location. This displacement causes customer dissatisfaction upon tearing out a perforated portion of the box behind which the spout should be located and not finding it there.

To overcome these shortcomings in past devices, often, it has been necessary to station a person at the loader to aid in guiding the bag into the box or to finesse the bag after it has been placed in the box to decrease the likelihood of damage and spout misalignment. This repositioning is done by additional personnel who perform this repositioning while the bags and boxes move on conveyors. This repetitive motion can lead to injuries and any time there is additional rubbing movement of the bag there is a potential for bag and/or product damage. When the bag rubs against the sharp edges of the cardboard box it causes unacceptable injuries to the bag which can cause leaks in the bag and/or product rejection or returns by the consumer if not immediately identified.

Alternately, an excess clearance has been added to the box depth to assure that when the bag is placed in the box it does not extend up over the edges of the box and remains undamaged through the final box closing process.

Damage to the bag is especially critical where the beverage contained in the bag, such as wine, deteriorates with exposure to oxygen. Oxygen may enter the bag as a result of holes in the barrier layer of the film caused by the loading process.

In the prior art devices the liquid filled bag is conducted to a drop or release location. At the drop location, the bag is released into a chute or slide which is supposed to convey the bag into the box and keep the bag in a desired predetermined orientation with the box. Because of the nature of liquid in a bag and the freedom of the bag to deform to any outside or inside pressure, the movement of a bag through a chute for any distance where the bag changes direction and has the opportunity to roll can and does cause displacement of the spout and damage to edges of the bag when it touches or presses against sources of injury. When a direction changing chute is used to convey the bag, the positioning of the bag lacks the consistency required to provide a packaging system with a high quality and commercially acceptable defect rate.

SUMMARY OF THE INVENTION

A apparatus and method is disclosed and provides for loading of a liquid filled bag into a rigid container. The apparatus straightens the bag as it moves into a loading position. A continuously rotating roller across which the bag rolls to enter the loading position, urges the bag into the loading position. Side and back walls to the loading position prevent the bag from moving to the sides or back. At the loading position, the bag and the liquid in the bag are stabilized. The loading position is located on trap doors directly above the box into which the bag is to be loaded. Once the bag is at the loading position, a tamper is activated which comes down and lightly tamps the bag to help accelerate its stabilization. Once the bag has been stabilized, it is released through the nearly frictionless trap doors and gently free-falls through a vertical guide chute into the box. The bag is thereby directed into its box in precisely the same way each and every time at a relatively high loading rate (20 bags/min) without the requirement of manual manipulation.

Many of the surfaces which touch the bags are Teflon coated to reduce friction and any likelihood of injuring the bag. The Teflon coated trap door tops each have pinhole nozzles on their top to provide an air layer between the trap doors and a bag it supports. When the trap doors are horizontal they float a bag in the loading position on a layer of air. This air layer creates virtually no friction between the top of the trap doors and allows the bag to free-fall vertically through the opening between the doors without any drag from the doors surfaces.

Position sensors are connected to a programmable controller which coordinates each step of the loading process.

DETAILED DESCRIPTION

Figure 1:
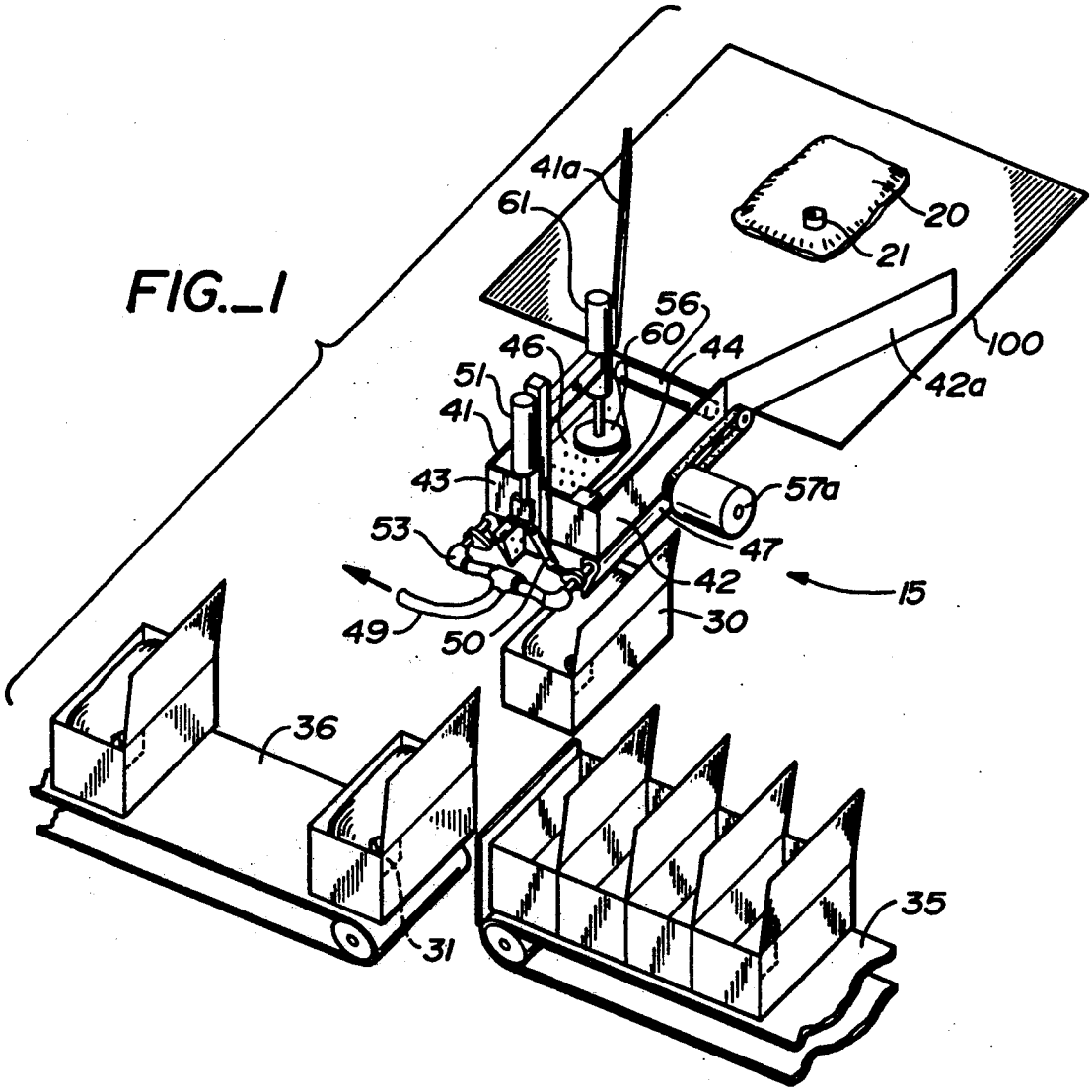
FIG. 1 shows an overall perspective view of an embodiment of the invention.

An overall view of an embodiment according to the invention can be seen in FIG. 1. This embodiment minimizes the risk of the prior art while providing added productivity benefits with low cost components. A loading device is as presently configured is expected to load approximately 20 boxes with bags in a minute. This is done with a negligible amount of bag damage, i.e. without breaching the oxygen and physical barriers of the bag.

A filled bag 20 having a spout 21 arrives at the loading device 15 on a conveying device such as a roller conveyor 100 as shown in FIG. 1. The roller conveyor 100 conveys the filled bag 20 from a bag filler (not shown) to the loading device 15. Other types of conveyors such as belt conveyors can also be used (conveyors that do not rub the bag are preferred). Because the filled bag 20 is conveyed to the loading device 15 via a conveyor, the loading device 15 does not have to be located exactly at the location of or adjacent to the bag filler. Bag conveying could take place over a long distance. This conveying capability provides added flexibility for plant layout and the potential additional space increases maintenance options when parts change overs are done.

An important consideration in loading the bag 20 into the box 30 is getting the bag 20 to go into the box 30 consistently. This requires controlling the movement of the liquid in the bag. When the bag 20 is placed on a conveyor which is at an angle the fluid in the bag is likely to move around inside the bag's walls, influencing the bag to roll and seek its point of lowest potential energy. To minimize this rolling, the bags are rectangularly shaped approximately 15 inches by 13¾ inches when flat. When the bags are filled with fluid they are approximately 13¼ inches by 12 inches by 2 inches. The low height of the bag in relation to its length and width tends to retard its tendency to roll. Nevertheless, the fluid in the bag vibrates or sloshes inside the bag whenever the bag is accelerated as in a starting motion, a stopping motion or when turning a corner and these motions can cause the bag to roll if the acceleration is severe. It is therefore very difficult to align the bag by pushing it, as there is a time delay between the force imparted the bag and the bag's actual movement.

The bag 20 as it moves on the conveyor 100 can for a variety of reasons can be misaligned so that the longitudinal axis of the bag is not parallel to the axis of conveyor 100 but is skewed. This embodiment of the invention provides that even though the longitudinal axis of the bag 20 is skewed, as much as 45 degrees, the loading device 15 is able to re-orient the bag to its preferred parallel orientation before it moves into its loading position 19 and into is placed in its box 30. As the bag 20 moves on the conveyor 100 it moves between two wing sidewalls 41*a*, 42*a*. If the bag is displaced from the central axis of the loading device 15*a* then the wing sidewalls 41*a*, 42*a* deflect the bag 20 back towards the center and also assist in turning the bag 20 to its correct orientation. The angle of the wing sidewalls 41*a*, 42*a* from the center axis of the loading device 15 which is generally aligned with the longitudinal center line of the conveyor 100 is preferably 13 degrees from the center line to each wing sidewall.

The incline of the roller conveyor 100 (in this embodiment 22 degrees) causes fluid in the bag 20 to roll towards the loading device 15. As the bag 20 moves, the sidewalls push the bag back to the center line of the conveyor 100 and the bag is directed to across a drive roller 56 and enters its loading position 19, within the sidewalls 41, 42, the back wall 43, and above an air table consisting of two Teflon coated trap doors 46, 47. As the bag 20 is conveyed from the bag filler (not shown) to the loading device 15, a variety of operations and inspections can take place. These additional operations can include bag washing, bag drying, bag inspection and/or quality control rejection.

As the bag 20 reaches the rotating drive roller 56, provides an impulse (pushpull) to the bag to move it from conveyor 100 across the drive roller 56 into its loading position 19 over the air table trap doors 46, 47. The drive roller is driven by a drive 57 consisting of a drive motor 57*a*, pulleys 57*c*, 57*d* and a toothed drive belt 57*b*. The drive roller 56 has an approximate diameter of 1 inch and turns at approximately 1060 rpm.

Figure 6:
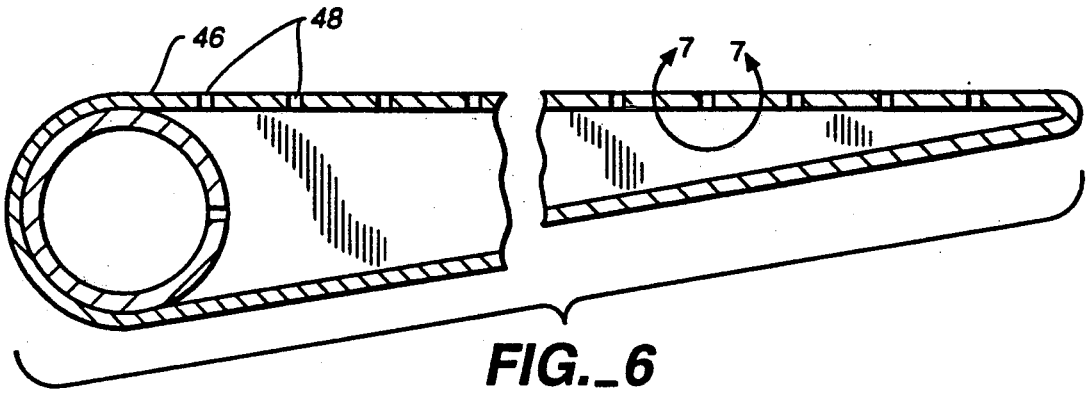
FIG. 6 shows a cross sectional view of a trap door according to the invention.
Figure 7:
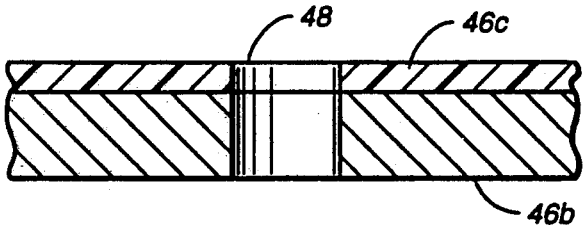
FIG. 7 shows a close-up view of an air nozzle as shown in FIG. 6.

The air table trap doors 46, 47 are constructed of hollow wing shaped cross section pieces as shown in FIG. 6. Air is directed into the hollow chamber of the trap doors and exits nozzles 48 in the top of these doors to float the bag 20 on a layer of air, thereby nearly eliminating any friction between the trap doors 46, 47 and the bag 20. Once the bag 20 reaches this loading position 19, it has the opportunity to stabilize itself between the side walls 41, 42 and the back wall 43 and is prevented from moving back towards the conveyor 100 by the continuous rotation of the drive roller 56. If the bag sloshes into contact with the drive roller 56, the roller 56 again pushes the bag towards the back wall 43.

Figure 2:
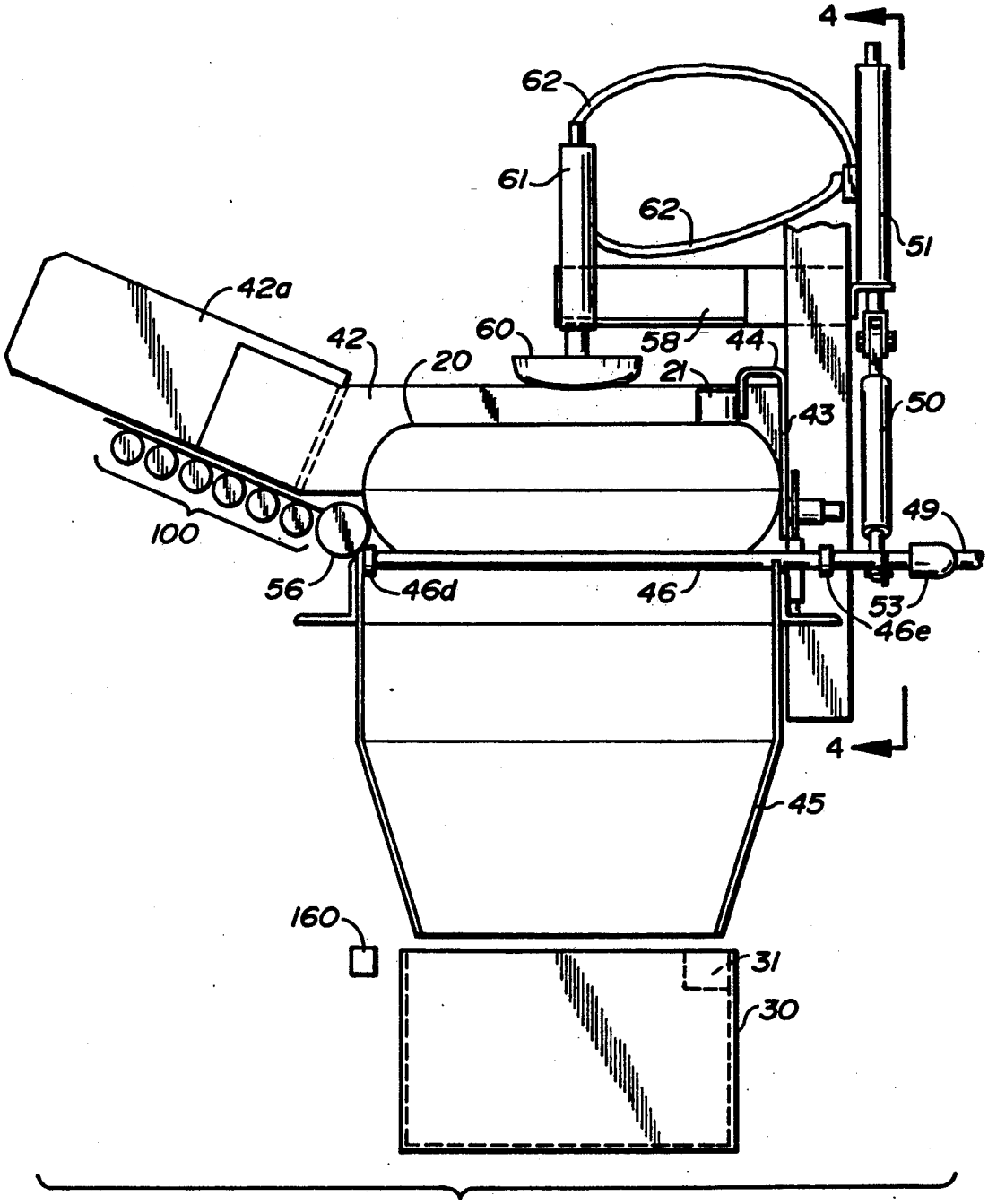
FIG. 2 shows a cut-away view of an embodiment of the invention with the bag tamper retracted.

Another feature of this embodiment is the fact that the spout 21 of the bag is prevented from rolling towards the back wall 43 by a spout stop 44 attached to the back wall 43. The bottom edge of the spout stop 44 is 2¼ inches above the air tables 46, 47 and touches only the spout 21 of the bag 20 as it reaches the back wall of the loading position 19 (FIG. 2). Without this spout stop 44 the heavy spout 21 has a tendency to roll towards the back wall 43. The spout stop 44 assists in decreasing the time needed to stabilize the bag 20. However in another configuration (not shown) where the bag enters the loading device 15 with the spout 21 trailing rather than leading (as shown in FIG. 1), there is no need for a spout stop 44. The box knock-out 31 location and/or box orientation would be changed to match. For such a configuration a spout stop 44 would not be provided.

As the bag 20 crosses the drive roller 56 entering its loading position, a proximity sensor 150 senses the presence of the bag 20 and after an approximately 400 millisecond delay, a tamper 60 attached to a tamper ram 61 extends towards the bag and slightly depresses (approximately ½ inch) the center of the bag 20. This tamping causes the liquid sloshing action in the bag to immediately cease and the liquid in the bag 20 to become nearly still. The tamper 60 is approximately 4 inches in diameter and is preferably covered with a smooth plastic (such as ultra-high molecular weight (UHMW) plastics) to avoid damaging the bag 20. The distance 63 between the extended tamper 60 and the top of the air table trap doors 46, 47 is approximately 1½ to 2 inches.

The top of the air table trap doors 46, 47 are coated with a Teflon coating 46c such as commonly applied to pots and pans for ease of cleaning. This coating 46c insures that even once the layer of air supporting the bag 20 in its loading position 19 has been distorted, so that there is contact between the bag and either of the air table trap doors 46, 47 there will be little or no friction and misdirection of the bag 20.

Figure 4:
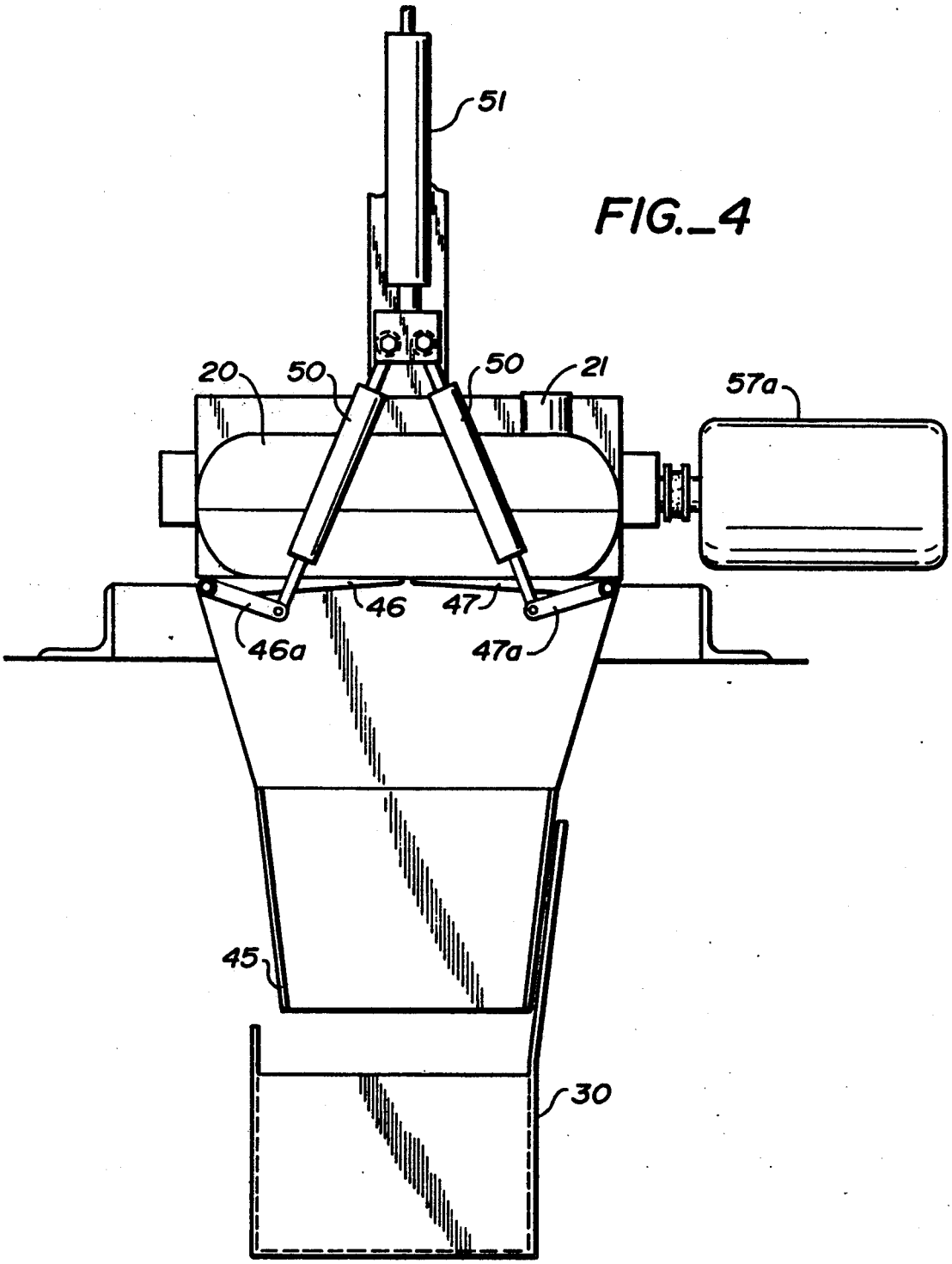
FIG. 4 shows a cut-away back view of an embodiment of the invention with the bag in a loading position.
Figure 4A:
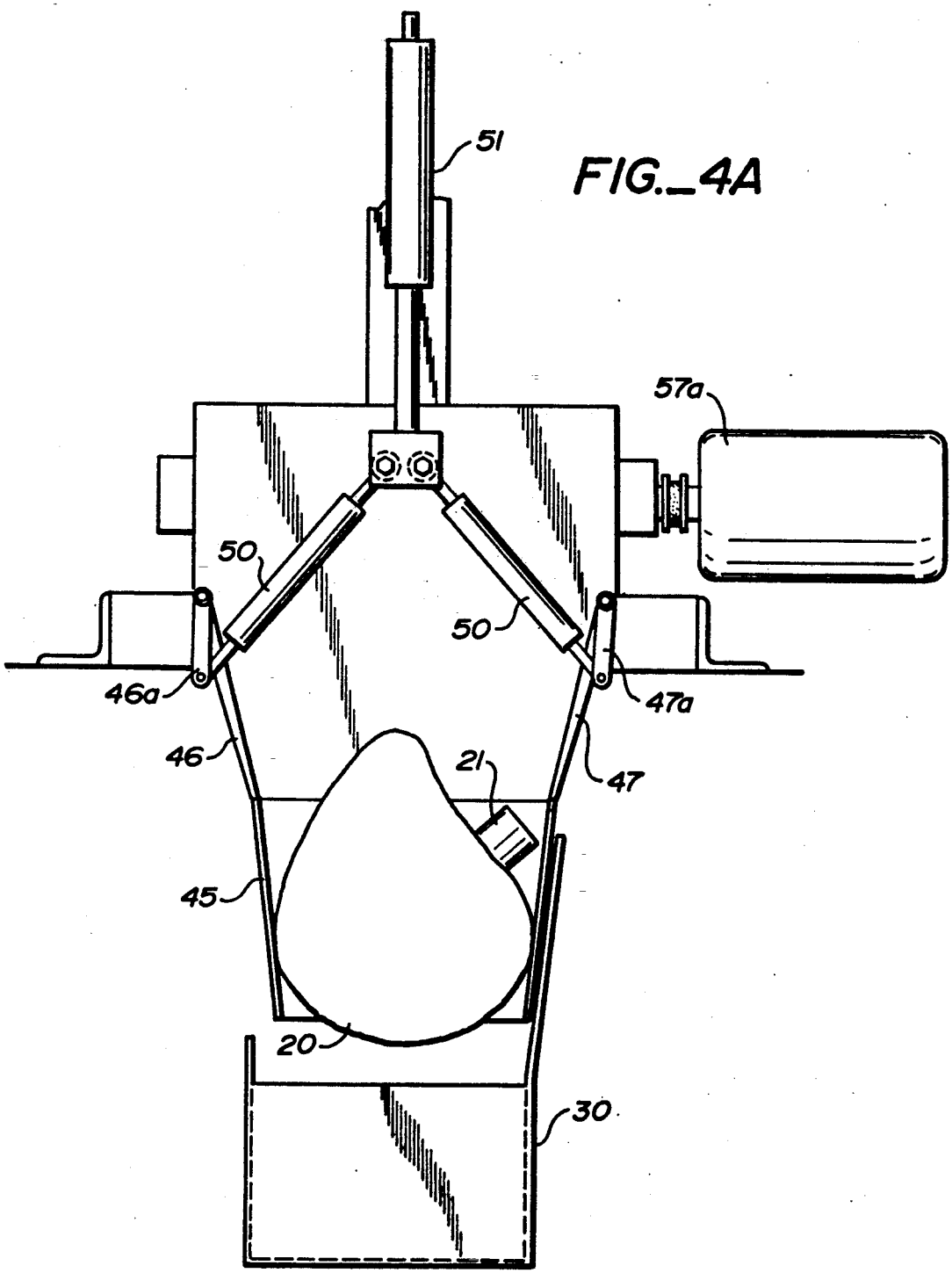
FIG. 4A shows a cut-away back view of an embodiment of the invention with the trap doors open.

Once the fluid in the bag has been stabilized by the lowering of the tamper 60, a programmable controller (not shown) checks a photo sensor 160 which senses whether a box 30 is present under the chute 45 to accept the now stabilized bag 20. If a box 30 is present and is ready to be loaded, a trap door ram 51 connected to both trap doors 46, 47 through a trap door linkage 50 moves the air table trap door control links 46a, 47a as shown in FIGS. 4 and 4A to lower (release) the trap doors 46, 47 and let the bag 20 drop freely through the Teflon coated chute 45 into its box 30 after approximately 300 milliseconds after the tamper ram has been extended. After the trap doors 46, 47 have been released and approximately a ½ second has elapsed the trap door ram 51 is retracted and the "full" box movement mechanism (to remove the box 30 from below the chute 45) (not shown) is activated. Once the bag 20 has fallen from the air table the proximity sensor 150 senses that there is no longer a bag in the loading position 19 and the programmable controller can once again release a bag from the filler to the now vacant loading position 19.

The size of the filled bag is 13½ by 12 by 2 in its free sitting position. The distance between the right side 23 wall 41 and the left side wall 42 is approximately 9½ inches. The distance between the back wall 43 and the edge of the drive roller is approximately 13 inches. Therefore, the bag is squeezed slightly between the two side walls 46, 47 when it enters its loading position 19.

When the bag is released from the air table by the trap doors 46, 47 it falls into a chute 45 which has narrowing walls (with discharge dimensions of 9.25 inches by 6.82 with 7.3 degree and 6.5 degree rectangular guides angles, respectively) so that the bag from the discharge of the chute 45 can fit into the inside of the box 30 which measures approximately 10⅛ inch by 7½ inches by approximately 5 inches high. In this way the spout 21 of the bag 20 is consistently located adjacent to a knock-out portion 31 of the box 30. This knock-out 31 is a perforated section of the box 20 which is torn out by a user to access the spout 21.

An example of box 30 movement during and after filling is shown in FIG. 1. A conveyor 35 conveys boxes 30 which have been formed into a tray shape from a box set up machine (not shown). An advantage of this invention is that it fills boxes which are set up in a tray configuration. The advantage of filling a box in the tray configuration is that the box blank which is purchased from a container vendor can be shipped from the container vendor to the bag filler and loader with the box completely flat and unglued. The machine to form a flat blank of cardboard into an opened top tray box ready to receive a bag 20 is relatively simple and it reduces the cost of the box when compared to other types of boxes which have similar final dimensions but have been folded and glued into a tube at the box factory. As the boxes 30 arrive on the conveyor 35 they back up to one another. A slide mechanism (not shown) slides the box off the side of the conveyor and then forward to a position under the chute 45 ready to receive the bag 20. Alternately, the box can be conveyed to the position under the chute by many means including a decending spiralling chute from above. Once the bag 20 has been gently dropped into the box 30 from the loading device 15, a pushing mechanism pushes the now loaded "full" box 30 from under the chute 45 and onto a discharge conveyor 36. The discharge conveyor 36 takes the boxes 30 to their next station where other activities such as automatic tucking of the bag's corners, quality control activities, and/or closing of the top flaps of the box can take place.

A cross sectional side view cut across the loading position of the bag 20 with the right side wall 41 and wing sidewall 41a removed is shown in FIG. 2. In this view the tamper ram 61 is in its retracted position. The tamper ram 61 is a pneumatically powered ram and is fed by air tubing 62. The tamper ram 61 is supported by a tamper/trap door ram support arm 58.

The bag 20 is supported by two symmetrical trap doors 46, 47 only one 46 of which can be seen in FIG. 2. The trap door 46 is supported by two hinge/bearings 46d, 46e. The two hinge/bearings 46d, 46e allow the trap door 46 to pivot on an axis between these two bearings to act as a hinge when the trap door control link 46a which is hidden from view in FIG. 2, is moved to its open position. The trap door control link 46a can be seen in FIGS. 4 and 4A. A trap door swivel connection 53 is provided at the end of the round hollow tube forming the edge of the trap door 46. The swivel connection 53 allows the trap door to rotate without stressing the air tubing 49 supplying air to the holes in the trap door at approximately 20 psi.

Figure 2A:
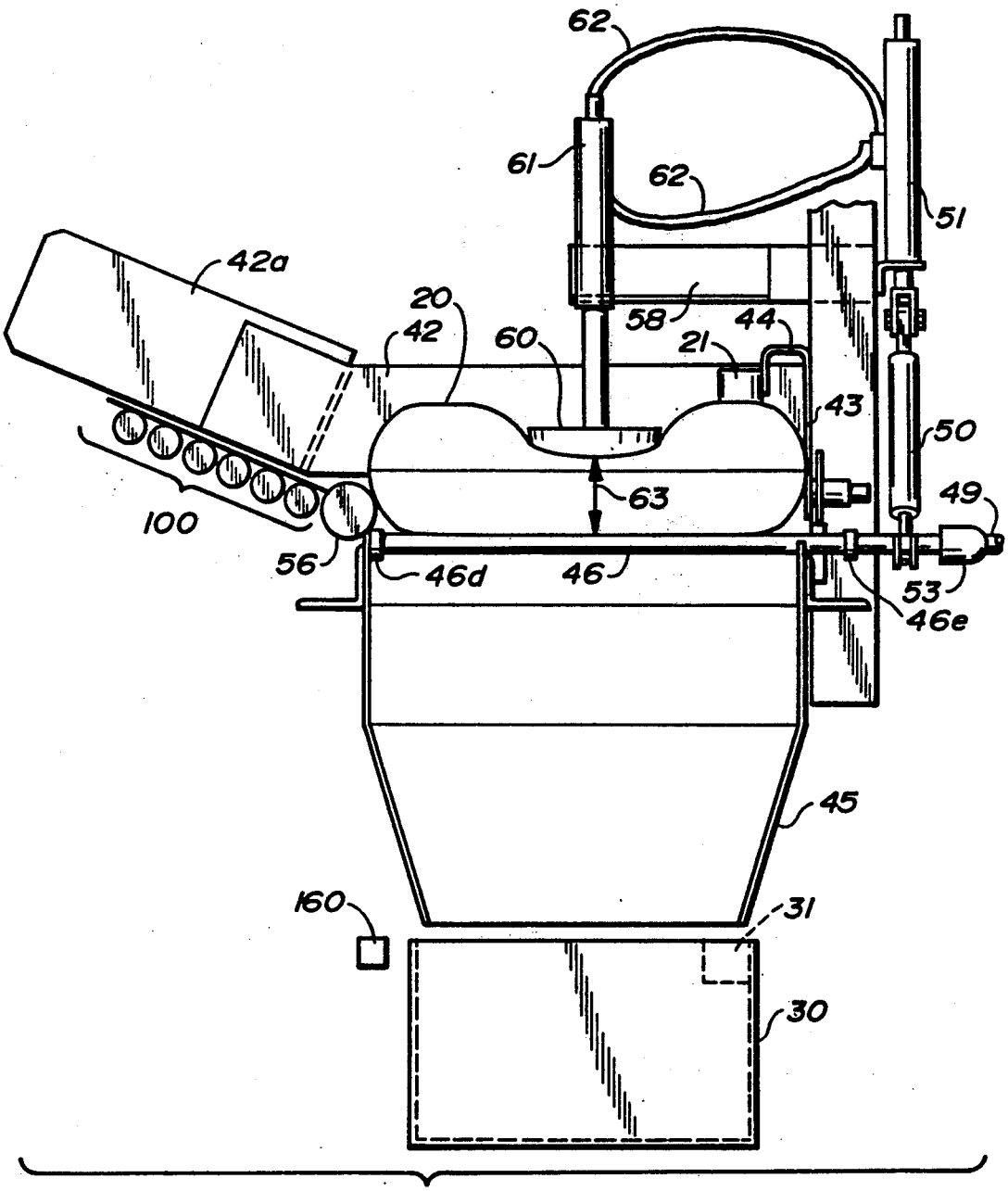
FIG. 2A shows a cut-away side view of an embodiment of the invention with the tamper extended.

The tamper ram 61 is shown extended in FIG. 2A. It shows the somewhat stabilizing effect of gentle tamp pressure at the center of the bag 20.

All wall surfaces 41, 42, 43 around the loading position 19 are smooth and all corners have been rounded to assure that the bag will not be damaged.

Figure 3:
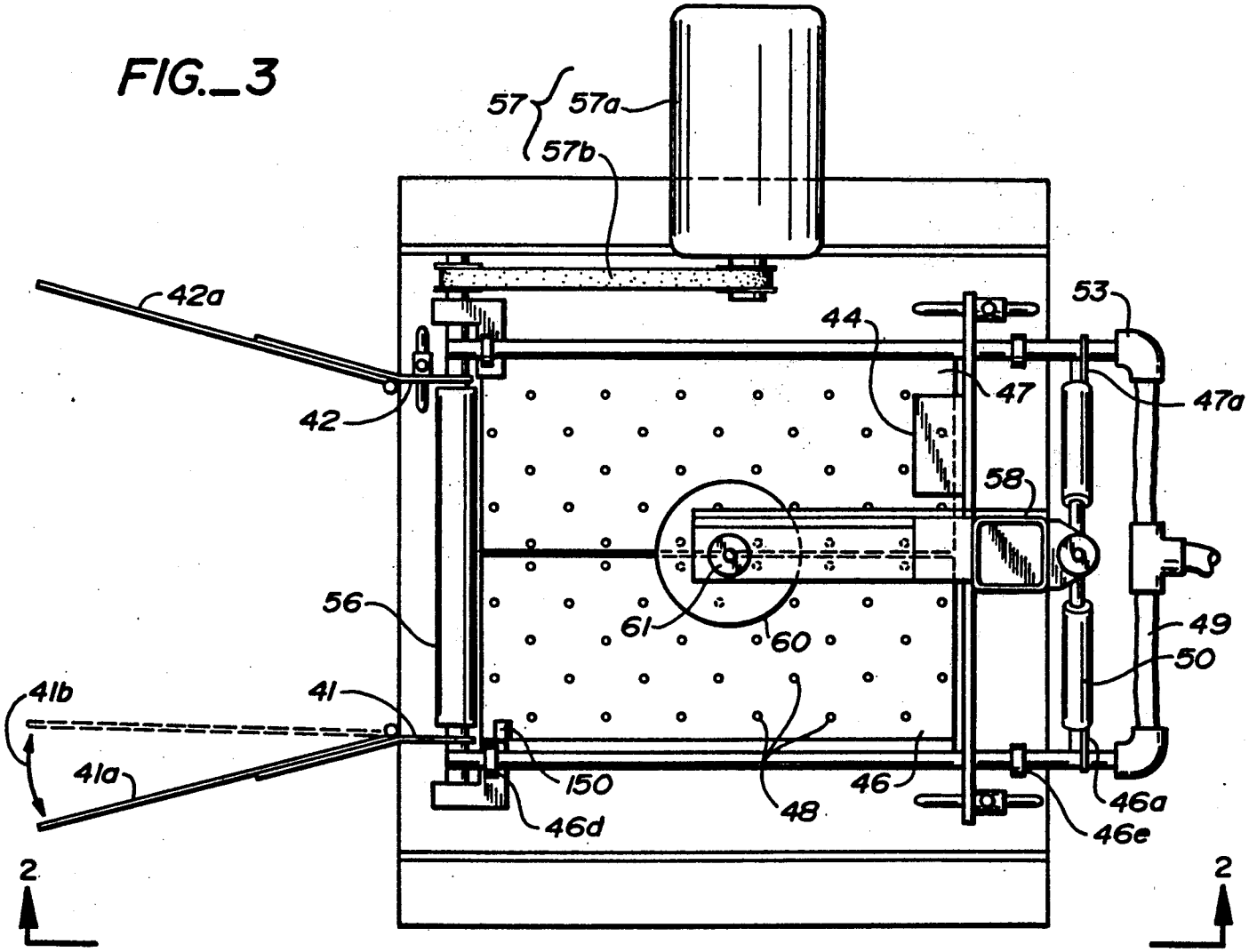
FIG. 3 shows an top view of an embodiment of the invention.

A top view of the embodiment according to the invention is shown in FIG. 3. As the bag 20 comes in from the left it moves between the two side wing walls 41a, 42a. These side walls are preferably set at an angle of approximately 13 degrees from the center line 41b. The bag moves across a roller 56 into the loading position 19 sitting on trap doors 46, 47. The top of the trap doors 46, 47 are coated with a coating of Teflon 46c. The tops of the doors 46, 47 are drilled with holes 48 approximately in a pattern as shown in FIG. 3. Each hole is approximately 0.062 inches in diameter. The holes are drilled in a 1.4 inch square pattern with the square pattern rotated 45 degrees. The passage of air through the trap door 46, 47 can be seen in FIGS. 3 and 6. Air which originates from a common tube source 49 is distributed through a tee fitting through tubing 49 and swivel connections 53 into the end of a hollow tube at the lateral edge of the trap door 46, as can be seen in FIG. 6. The other end of the tube is closed. Holes in the side of the tube allow air to enter the wing shaped plenum. The air holes 48 in the top surface of the plenum evenly distribute the air and air pressure throughout both trap doors 46, 47 to the provide a uniform cushion of air under the bag when it is in its loading position 19.

The size of the bag to be loaded can be adjusted by moving the back 43 and/or side walls 41, 42 as necessary to adjust to a new bag size and replacing the chute 45 to accommodate a new bag and/or box size.

Another advantage of this invention is that with its more precise and loading it is able to reduce the required box height. There is no longer the need to provide extra clearance to accommodate mis-oriented bags as often occurred in prior art devices.

The trap door linkage can be seen in FIG. 4 (the back wall 43 and tamper/trap door support arm are not shown). When the bag 20 is in its loading position 19 the trap door ram 51 is in its retracted position and through the trap door linkage 50 holds the trap door control links 46*a*, 47*a* up to hold the trap doors 46, 47 in a generally horizontal position. When the trap door ram 51 and its connected linkage 50, and the trap door control links 46*a*, 47*a* are extended (FIG. 4A) the trap doors 46, 47 move to a downwardly directed position to release the bag 20, which as it falls assumes a teardrop like shape as it falls through the chute 45 into the box 30. After approximately ½ second, the trap door ram 51 then retracts to raise the trap doors 46, 47 to their horizontal position to await the next bag to be loaded.

Figure 5:
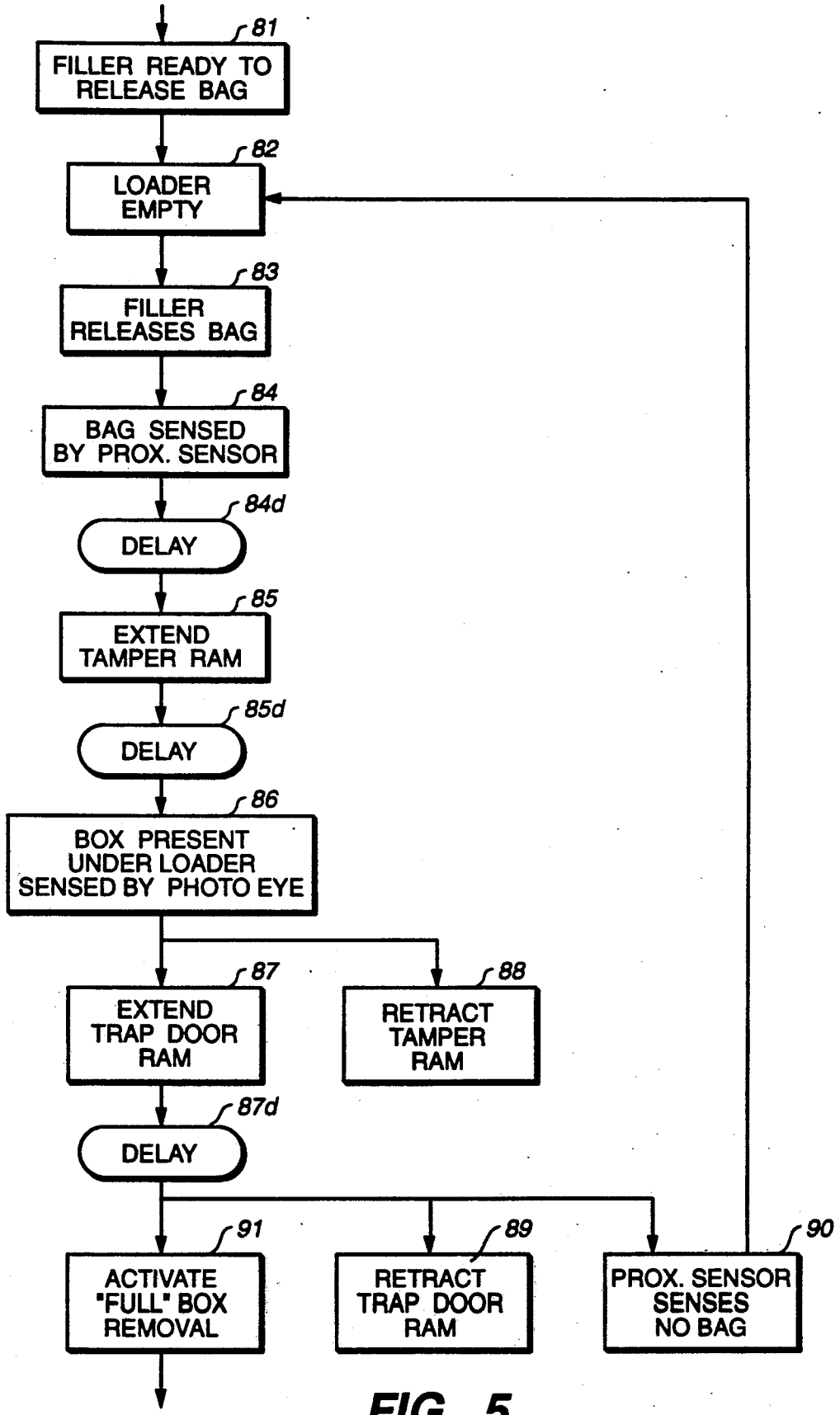
FIG. 5 shows a flow diagram showing the steps of a method according to an embodiment of the invention.

The sequence of events coordinating the loading device 15 with its upstream and downstream machinery as shown in FIG. 5. When the bag filler is ready to release the bag (81), the loader must be empty (82). If the loader is not empty, the bag filler waits until the loader is empty before the filler releases the bag (83). As the bag is entering the loading device, the proximity sensor 150 senses the bag (84) and the programmable controller (not shown) activates a timer to delay (approximately 400 milliseconds) (84*d*). After the 400 millisecond delay, during which time the bag has fully entered the loading device 15 and has sloshed around and centered itself to some extent, the tamper ram is extended (85). There is an approximately 300 millisecond delay (85*d*) as the tamper 60 extends and the bag 20 is stabilized. Once the bag 20 is stabilized if there is a box underneath (86), the trap door ram is extended (87) and the bag 20 drops into the box 30 through the chute 45. At the same time the bag 20 is dropped, the tamper ram 61 is retracted into its original position (88). After the trap door ram 51 has been extended for approximately 500 milliseconds (delay (87*d*)), the trap door ram 51 is retracted (89). The proximity sensor 150 then senses no bag in the loading position and relays that signal to the programmable controller (90)(82). The "full" box removal mechanism is also then activated (91).

All pieces are preferably constructed of stainless steel as is preferred for most beverage handling machinery.

The present invention may suitably comprise, consist of, or consist essentially of the elements of the side walls, the trap doors, the trap door air table and the trap door release mechanism. Other elements of the invention may also be added as essential including the drive roller and the guide wings for directing the bag into its loading position as well as a tamping device as deemed appropriate by one skilled in the art.

While the invention has been described with regards to specific embodiments, those skilled in the art will recognize that changes can be made in form and detail without departing from the spirit and scope of the invention.

We claim:

1. A flexible liquid holding container loading device comprising;

a set of trap doors;

means for providing an air cushion between said trap doors and the flexible liquid holding container disposed on said trap doors;

barrier means generally surrounding a top of said trap doors for restraining the flexible liquid holding container from moving sideways off of said trap doors once the liquid holding container is disposed on top of said trap doors; and means for opening said trap doors.

2. A flexible liquid holding container loading device as in claim 1, wherein a set of top surfaces of said set of trap doors is coated with a friction reducing material.

3. A flexible liquid holding container loading device as in claim 1, wherein said means for providing an air cushion is comprised of generally symmetrical passages in each one of said set of trap doors connected to a common air source.

4. A flexible liquid holding container loading device as in claim 1, further wherein said barrier means includes means for urging the flexible loading container into said loading position from an adjacent position.

5. A flexible liquid holding container loading devices as in claim 4, wherein said means for urging is a drive roller.

6. A flexible liquid holding container loading device as in claim 1, wherein said means for opening said trap doors includes a generally symmetrical linkage connected to a common driven link.

7. A flexible liquid holding container loading device as in claim 1, further comprising means for accelerating the stabilization of the flexible loading container in said loading position.

8. A flexible liquid holding container loading device as in claim 7, wherein said means for accelerating the stabilization is a tamper.

9. A flexible liquid holding container loading device as in claim 8, wherein said tamper has a size less than a size of the flexible liquid holding container when disposed on said trap doors.

10. A flexible liquid holding container loading device as in claim 9, said tamper is disposed to touch at approximately a center of the flexible liquid holding container when extended.

11. A flexible liquid holding container device as in claim 1, further comprising means for guiding the flexible liquid holding container into a container directly below the trap doors.

12. A flexible liquid holding container loading device as in claim 11, wherein said means for guiding is a chute having an inside surface, said inside surface being coated with a friction reducing material.

13. A flexible liquid holding container loading device as in claim 1, wherein said barrier means includes a spout stop.

14. A flexible liquid holding container loading device comprising:

means for receiving a bag from a feeder;

means for supporting the flexible liquid container directly above a box to be loaded;

means for holding said flexible liquid holding container in a generally stationary position on said means for supporting;

means for accelerating the stabilization of the flexible loading container in said stationary position; and means for releasing said flexible liquid container to fall vertically into a box from said means for supporting.

15. A method for loading a flexible liquid container into the top of a tray type box comprising the steps of;

receiving the container into a loading position in a horizontal position;

stabilizing the container in the loading position;

dropping the container vertically through a set of trap doors from said loading position into a box.

16. An apparatus comprising:

a set of trap doors, each trap door of said set rotatable about its own support axis from a closed to an open position;

means for providing an air cushion between said trap doors and a container disposed on said trap doors; and means for opening said trap doors together.

17. An apparatus as in claim 16, wherein said set of trap doors are generally horizontal when closed.

* * * * *